US008413744B2

(12) United States Patent
John et al.

(10) Patent No.: US 8,413,744 B2
(45) Date of Patent: Apr. 9, 2013

(54) SYSTEM AND METHOD FOR CONTROLLING THE INTEGRITY OF A DRILLING SYSTEM

(75) Inventors: Hendrik John, Celle (DE); Joachim F. Oppelt, Niedersachsen (DE); Jing Xu, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 12/511,456

(22) Filed: Jul. 29, 2009

(65) Prior Publication Data

US 2010/0025110 A1 Feb. 4, 2010

Related U.S. Application Data

(60) Provisional application No. 61/085,107, filed on Jul. 31, 2008.

(51) Int. Cl.
*E21B 44/00* (2006.01)

(52) U.S. Cl.
USPC ..... 175/57; 175/27; 175/45; 166/902

(58) Field of Classification Search ..... 175/27, 175/24, 40, 45, 57; 166/902
See application file for complete search history.

(56) References Cited

U.S. PATENT DOCUMENTS

| | | | | |
|---|---|---|---|---|
| 3,301,323 | A * | 1/1967 | Parsons | 175/66 |
| 3,732,052 | A * | 5/1973 | Gunia | 425/219 |
| 5,474,142 | A * | 12/1995 | Bowden | 175/27 |
| 6,179,066 | B1 * | 1/2001 | Nasr et al. | 175/45 |
| 6,233,524 | B1 * | 5/2001 | Harrell et al. | 702/9 |
| 6,478,950 | B1 | 11/2002 | Peat et al. | |
| 6,662,110 | B1 * | 12/2003 | Bargach et al. | 702/6 |
| 6,732,052 | B2 | 5/2004 | Macdonald et al. | |
| 7,533,725 | B2 * | 5/2009 | Mese et al. | 166/308.2 |
| 7,542,853 | B2 * | 6/2009 | Lapierre et al. | 702/6 |
| 7,650,241 | B2 * | 1/2010 | Jogi et al. | 702/9 |
| 7,823,656 | B1 * | 11/2010 | Williams | 175/38 |
| 2001/0023614 | A1 | 9/2001 | Tubel | |

OTHER PUBLICATIONS

Notification of Transmittal of the International Preliminary Report on Patentability and the Written Opinion of the International Searching Authority, or the Declaration; PCT/US2009/052476; Feb. 10, 2011.

(Continued)

*Primary Examiner* — Nicole Coy
(74) *Attorney, Agent, or Firm* — Cantor Colburn LLP

(57) ABSTRACT

A system for monitoring and controlling a load on a downhole component of a well drilling system is disclosed. The system includes: a downhole tool disposed in a drillstring and configured to be movable within a borehole, the drillstring configured to allow a drilling fluid to be advanced therethrough and into the borehole; at least one sensor disposed within the downhole tool for in-situ measurement of at least one physicochemical property of an environment surrounding the downhole tool; and a processor configured to monitor the at least one physicochemical property and at least one of i) provide physicochemical property information to a user during a drilling/steering operation, ii) adjust a load on the downhole component based on the environment information and iii) shut down the system in response to a detection of a measured physicochemical property beyond a selected threshold.

20 Claims, 6 Drawing Sheets

OTHER PUBLICATIONS

G. Speranza, S. Torrengo, L. Minati, M. Filippi, M. Castellino, Cl. Manfredotti, Ch. Manfredotti, M. Dipalo, A. Pasquarelli, E. Kohn, Hayssam El-Hajj and E. Vittone, "Characterization of UV irradiated nanocrystalline diamond", Diamond and Related Materials, vol. 17, 2008, pp. 1194-1198.

M. Dipalo, Z. Gao, J. Scharpf, C. Pietzka, M. Alomari, F. Medjdoub, J.-F. Carlin, N. Grandjean, S. Delage and E. Kohn, "Combining diamond electrodes with GaN heterostructures for harsh environment ISFETs", Diamond and Related Materials, vol. 18, 2009, pp. 884-889.

M. Adamschik, M. Hinz, C. Maier, P. Schmida H. Seliger, E. P. Hofer and E. Kohn, "Diamond micro system for bio-chemistry", Diamond and Related Materials, vol. 10, 2001, pp. 722-730.

M. Dipalo, C. Pietzka, A. Denisenko, H. El-Hajj and E. Kohn, "O-terminated nano-diamond ISFET for applications in harsh environment", Diamond and Related Materials, vol. 17, 2008, pp. 1241-1247.

M. Dipalo, J. Kusterer, K. Janischowsky, E. Kohn, "N-type doped nano-diamond in a first MEMS application", Physica Status Solidi (a), vol. 203 Issue 12, 2006, pp. 3036-3041.

Raymond Boreng, Terje Schmidt, Olav Vikane, Liv A. Tau, Statoil ASA ; Bjorn Dybdahl , Tor I. Dale, Oddfinn Thowsen, Petrotech ASA, "Downhole Measurement of pH in Oil & Gas Applications by Use of a Wireline Tool", SPE 82199 European Formation Damage Conference, May 13-14, 2003, The Hague, Netherlands.

* cited by examiner

FIG. 2
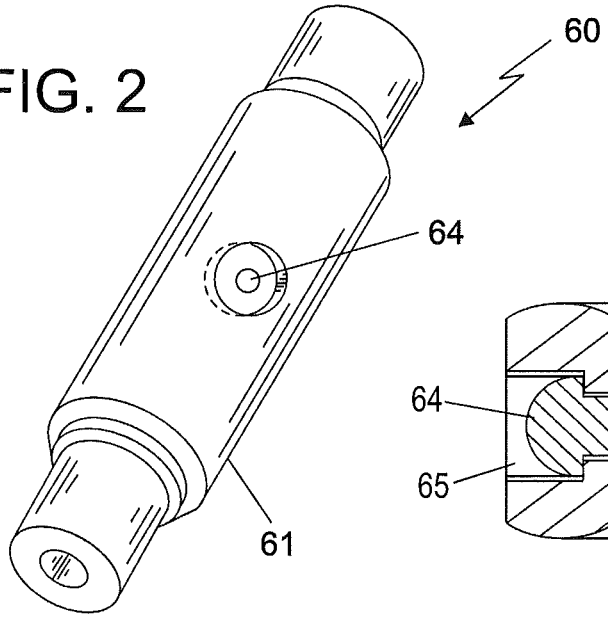
FIG. 3
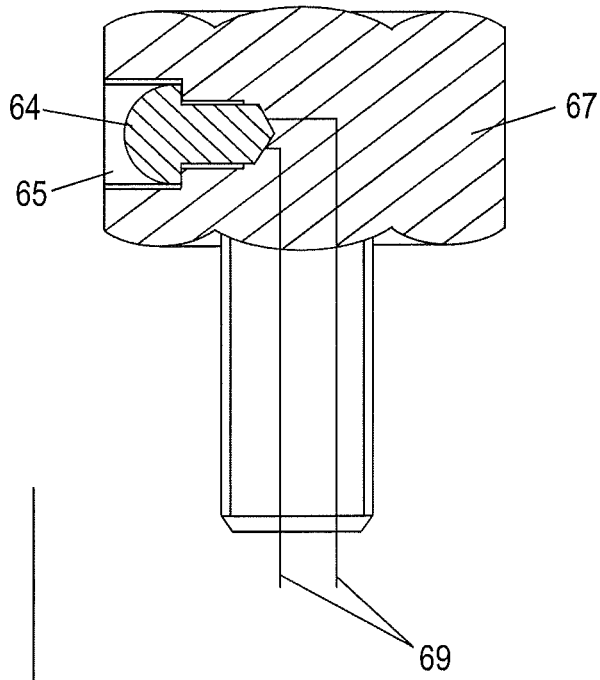
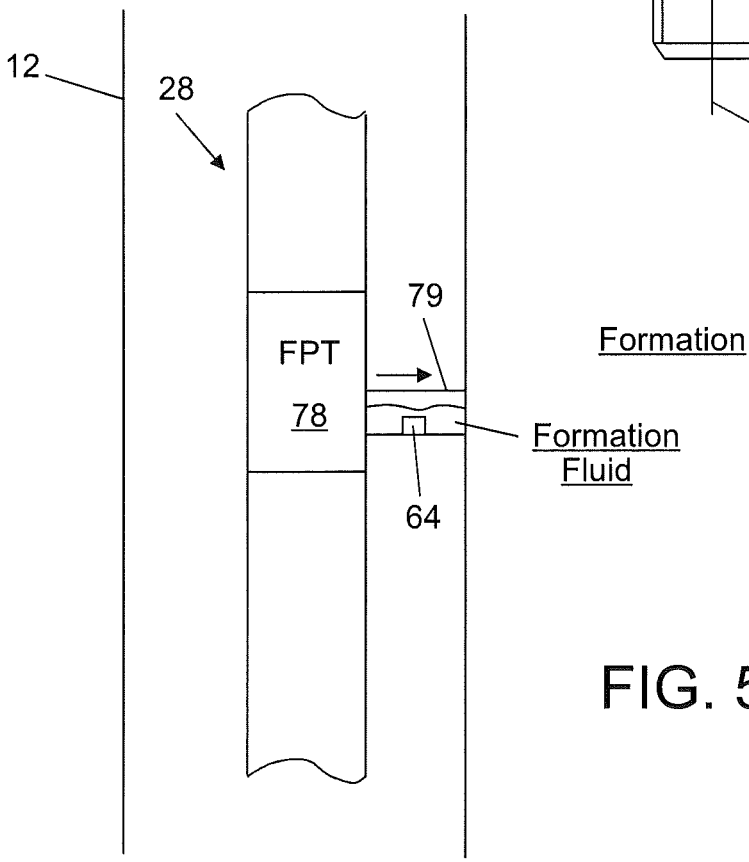
FIG. 5

SYSTEM AND METHOD FOR CONTROLLING THE INTEGRITY OF A DRILLING SYSTEM

CROSS REFERENCE TO RELATED APPLICATIONS

This application claims priority to U.S. Provisional Application Ser. No. 61/085,107 entitled "SYSTEM AND METHOD FOR CONTROLLING THE INTEGRITY OF A DRILLING SYSTEM" filed on Jul. 31, 2008, which is incorporated herein by reference in its entirety.

BACKGROUND

In hydrocarbon exploration operations, well boreholes are drilled by rotating a drill bit attached to a drillstring, and may be bored vertically or bored in selected directions via geosteering operations. Various downhole devices located in a bottomhole assembly or other locations along the drillstring measure operating parameters, formation characteristics, and include sensors for determining the presence of hydrocarbons.

An operator controls various drilling parameters during drilling operations to control drilling parameters in response to changing environmental conditions. Environmental factors include for example mechanical loads, heat and pressure, which put significant stress on components of exploration tools. Typical measurement techniques include monitoring the mechanical loads and the temperature. In addition, various chemical and physicochemical factors such as corrosive service media such as drilling fluid can also adversely impact exploration tools, such as drilling and/or geosteering tools. Such factors can degrade the tools and reduce their effective life cycles.

BRIEF DESCRIPTION OF THE INVENTION

A system for monitoring and controlling a load on a downhole component of a well drilling system includes: a downhole tool disposed in a drillstring and configured to be movable within a borehole, the drillstring configured to allow a drilling fluid to be advanced therethrough and into the borehole; at least one sensor disposed within the downhole tool for in-situ measurement of at least one physicochemical property of an environment surrounding the downhole tool; and a processor configured to monitor the at least one physicochemical property and at least one of i) provide physicochemical property information to a user during a drilling/steering operation and ii) adjust a load on the downhole component based on the environment information and iii) shut down the system in response to a detection of a measured physicochemical property beyond a selected threshold.

A method of monitoring and controlling a load on a downhole component of a well drilling system includes: disposing a downhole tool in a drillstring within a borehole, the downhole tool including at least one sensor disposed therein for measuring at least one physicochemical property of an environment surrounding the downhole tool; monitoring the at least one physicochemical property and at least one of i) providing physicochemical property information to a user during a drilling/steering operation and ii) adjusting a load on the downhole component based on the environment information, and iii) shutting down the system in response to detection of a measured physicochemical property beyond a selected threshold; and advancing a drilling fluid through the drillstring and into the borehole.

A computer program product stored on machine readable media for monitoring and controlling a load on a downhole component of a well drilling system by executing machine implemented instructions is disclosed. The instructions are for: disposing a downhole tool in a drillstring within a borehole, the downhole tool including at least one sensor disposed therein for measuring at least one physicochemical property of an environment surrounding the downhole tool; advancing a drilling fluid through the drillstring and into the borehole; and monitoring the at least one physicochemical property and at least one of i) providing physicochemical property information to a user during a drilling/steering operation, ii) adjusting a load on the downhole component based on the environment information, and iii) shutting down the system in response to detection of a measured physicochemical property beyond a selected threshold; and advancing a drilling fluid through the drillstring and into the borehole.

BRIEF DESCRIPTION OF THE DRAWINGS

The following descriptions should not be considered limiting in any way. With reference to the accompanying drawings, like elements are numbered alike:

FIG. 2 illustrates an exemplary embodiment of a micro-sensor disposed in a logging tool;

FIG. 3 illustrates an exemplary embodiment of the micro-sensor disposed in the head of a screw adapted for attachment to the drilling system;

FIG. 5 illustrates an exemplary embodiment of a formation pressure tester including the micro-sensor;

DETAILED DESCRIPTION OF THE INVENTION

The systems and methods described herein include chemical and/or physiochemical sensors in a downhole tool that allow for in-situ measurement of any potentially corrosive or other chemically induced attacks to the mechanical integrity of downhole components of a well drilling and/or geosteering system. The systems and methods, in some embodiments, include the capability to perform calculations, prepare physicochemical data and/or transmit the physicochemical data to a surface processor. The systems and methods may be utilized in real time to reliably control the integrity of the downhole components.

In one embodiment, controlling the integrity of the downhole components includes adjusting selected operating parameters, i.e., loads, such as the chemical consistence of a drilling fluid, a rotary speed of the drilling assembly, a weight-on-bit, and a duration of time in which the downhole components are disposed downhole or at bottom. Such adjustments can be implemented downhole or on the surface. In some embodiment, changes to the loads are automated or manually coordinated.

Figure 1:
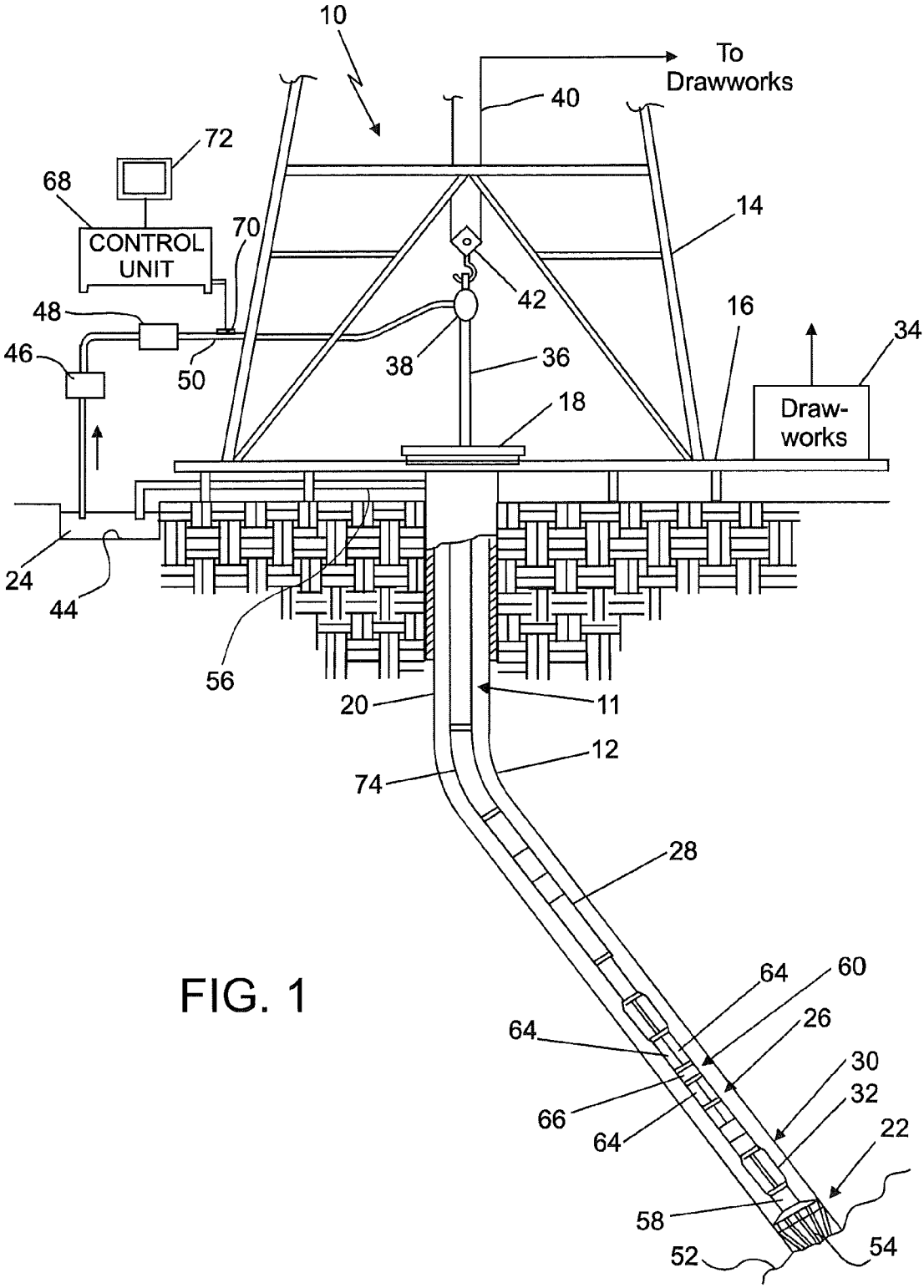
FIG. 1 depicts an embodiment of a drilling and/or geosteering system.

Referring to FIG. 1, an exemplary embodiment of a well drilling and/or geosteering system 10 includes a drillstring 11 that is shown disposed in a borehole 12 that penetrates at least one earth formation during a drilling operation and makes measurements of properties of the formation and/or the borehole 12 downhole. In one embodiment, such measurements are of physicochemical properties of the borehole 12 environment that are used to affect control of a drilling and/or geosteering operation. In one embodiment, measurements also include detecting the interaction between drilling tools and environmental media, such as tools' weight loss, thickness loss, and pitting caused by chemical or electrochemical corrosion.

As described herein, "borehole" or "wellbore" refers to a single hole that makes up all or part of a drilled well. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area). In addition, it should be noted that "drillstring" as used herein, refers to any structure suitable for lowering a tool through a borehole or connecting a drill to the surface, and is not limited to the structure and configuration described herein.

In one embodiment, the system 10 includes a conventional derrick 14 mounted on a derrick floor 16 that supports a mud motor including a rotary table 18 that is rotated by a prime mover (not shown) at a desired rotational speed. The drillstring 11 includes one or more drill pipe sections 20 or coiled tubing that extend downward into the borehole 12 from the rotary table 18, and is connected to a drill bit assembly 22. Drilling fluid, or drilling mud 24 may be pumped through the drillstring 11 and/or the borehole 12. The well drilling system 10 also includes a bottomhole assembly (BHA) 26.

The drill bit assembly 22 is powered by a surface rotary drive, a motor using pressurized fluid (e.g., the mud motor), an electrically driven motor and/or other suitable mechanism. In one embodiment, a drill motor or mud motor 28 is coupled to the drill bit assembly 22 via a drive shaft (not shown) disposed in a bearing assembly 30 that rotates the drill bit assembly 22 when the drilling fluid 24 is passed through the mud motor 28 under pressure. The bearing assembly 30 supports the radial and axial forces of the drill bit, the downthrust of the drill motor and the reactive upward loading from the applied weight on bit. In one embodiment, a stabilizer 32 coupled to the bearing assembly 30 acts as a centralizer for the lowermost portion of the mud motor assembly.

In one embodiment, the drillstring 11 is coupled to a drawworks 34 via a kelly joint 36, a swivel 38 and a line 40 through a pulley 42. During the drilling operation the drawworks 34 is operated to control drilling parameters such as the weight on bit and the rate of penetration ("ROP") of the drillstring 11 into the borehole 12.

During drilling operations a suitable drilling fluid 24 from a mud pit 44 is circulated under pressure through the drillstring 11 by a mud pump 46. The drilling fluid 24 passes from the mud pump 46 into the drillstring 11 via, for example, a desurger 48, a fluid line 50 and the kelly joint 36. The drilling fluid is discharged at a borehole bottom 52 through an opening in a drill bit 54. The drilling fluid circulates uphole between the drill string 11 and the borehole 12 and is discharged into the mud pit 44 via a return line 56.

In one embodiment, the drill bit assembly 22 includes a steering assembly including a shaft 58 connected to the drill bit 54. The shaft 58, which in one embodiment is coupled to the mud motor, is utilized in geosteering operations to steer the drill bit 54 and the drillstring 11 through the formation.

In one embodiment, the drilling assembly 22 is included in the bottomhole assembly (BHA) 26, which is disposable within the well logging system 10 at or near the downhole portion of the drillstring 11. The BHA 26 includes any number of downhole tools 60 for various processes including formation drilling, geosteering, and formation evaluation (FE) for measuring versus depth and/or time one or more physical quantities in or around a borehole.

The downhole tool 60, in one embodiment, includes one or more sensors or receivers 64 to measure various mechanical, chemical and/or physicochemical properties of the borehole environment, including the formation and/or the borehole 12. Examples of the sensors 64 include sensors for measuring acidity, electrical conductivity, and concentration in drilling fluid or gas of chemical compounds such as chlorides, oxygen, hydrogen, carbon dioxide ($CO_2$) and hydrogen sulphide ($H_2S$). Other examples include sensors 64 for measuring mechanical loads such as temperature, pressure, weight on the drill bit 54, drilling fluid flow and rotational speed of the drill bit 54. In one embodiment, the sensors 64 are configured to withstand high temperatures and pressures, such as temperatures of 150° C. (302° F.) and pressures of 1500 bar. The data provided by these sensors 64 is utilized to control and adjust environmental and/or mechanical loads on the tool 60, the drill bit 54 and/or other components of the drillstring 11 based on the tool-environment interaction and environmental impact of the associated physicochemical properties.

These physicochemical and/or mechanical measurements are utilized to adjust various loads on selected components of the drillstring 11. Such loads include various mechanical loads such as a weight on the drill bit 54, drilling fluid 24 flow through the drillstring 11, pressure and drill bit 54 rotational speed. Such loads also include environmental loads such as temperature, acidity, chemical composition, density and viscosity of the drilling fluid 24. Although the sensors 64 described herein are shown as part of the downhole tool 60, the sensors 64 are disposable at any selected location or locations in the drillstring 11.

In one embodiment, the taking of measurements from the sensors 64 is recorded in relation to the depth and/or position of the downhole tool 60, which is referred to as "logging", and a record of such measurements is referred to as a "log". Examples of logging processes that can be performed by the system 10 include measurement-while-drilling (MWD) and logging-while-drilling (LWD) processes, during which measurements of properties of the formations and/or the borehole are taken downhole during or shortly after drilling. The data retrieved during these processes may be transmitted to the surface, and may also be stored with the downhole tool for later retrieval. Other examples include logging measurements after drilling, wireline logging, and drop shot logging.

Each of the sensors 64 may be a single sensor or multiple sensors located at a single location. In one embodiment, one or more of the sensors 64 include multiple sensors located proximate to one another and assigned a specific location on the drillstring 11. Furthermore, in other embodiments, each sensor 64 includes additional components, such as clocks, memory processors, etc. The functionality of multiple sensors based on the working mechanism regime is designed and allocated to avoid mutual influence during the sensitizing/measurement operation.

In one embodiment, the sensor 64 includes at least one of: an acidity or pH level sensor, a chloride concentration sensor, a carbon dioxide ($CO_2$) sensor, a hydrogen sulphide ($H_2S$) sensor and an electrical conductivity sensor.

The acidity sensor allows a user to monitor the acidity level to control the corrosion rate of drillstring materials, such as steel or other metallic materials. Increased acidity may cause the corrosion rate of the drillstring materials to increase, resulting in potential failure. Change of acidity may change metallic materials' corrosion mechanisms, such as shifting from passivation status to activation status, and thus accelerate the corrosion rate of drilling tools. The drilling fluid, in response to an increase or decrease in acidity or a measurement of acidity beyond a selected threshold and/or range, may be treated to change the acidity to a selected level. For example, the drilling fluid is treated to lower or raise the acidity to affect a proper selected acidity having a neutral pH level, thereby reducing the corrosion rate. In another example, the drilling fluid is treated to lower the acidity, i.e., raise the pH level, to reduce the corrosion rate.

The chloride sensor detects a concentration of chloride ions in the drilling fluid 24. The corrosion rate of some drillstring materials increases with increasing chloride concentrations. For example, high chloride concentrations accelerate the localized corrosion of some metallic drillstring materials. The drilling fluid 24 may be treated to decrease the chloride concentration of the drilling fluid 24 upon detection of an increase of the chloride concentration or measurement of concentration that is above a selected threshold or outside of a selected range.

One non-limiting example of the sensor 64 for measuring pH and chloride ion concentration is available from Accentus plc of Oxfordshire, United Kingdom. This sensor includes an electrode for measuring the pH and/or the chloride ion concentration in the aqueous phase of a production fluid at a temperature greater than 85° C. and a pressure of up to 340 bar. The pH electrode is a glass film covering a sensor on an electrical insulating substrate. One benefit of this chemical sensor is being small enough to be disposed at several locations at the BHA 26 as well as along the drillstring 11. Another benefit is that this chemical sensor is self-cleaning by dislodging fouling from a cleaning membrane.

In one embodiment, the sensor 64 includes an electrical conductivity sensor. The electrical conductivity sensor is utilized to indicate the presence of air, which in turn is indicative of an increased concentration of oxygen and carbon dioxide. When air is introduced to the drilling fluid 24, a loss of conductivity occurs.

Oxygen, $CO_2$ and $H_2S$ detectors detect a concentration of the respective molecules in the drilling fluid 24. The corrosion rate of some drillstring materials increases with increasing concentrations of these species. Sensors for detecting $H_2S$ concentrations, in one embodiment, include hydrogen sensors. Use of these sensors allows for the drilling fluid 24 to be treated to decrease concentrations of Oxygen, $CO_2$ and/or $H_2S$ upon detection of an increase of the concentration or measurement of a concentration that is above a selected threshold or outside of a selected range.

In one non-limiting embodiment, the sensor 64 can be a micro-sensor. In general, micro-sensors are made up of components between 1 to 100 micrometers in size (i.e. 0.001 to 0.1 mm) while micro-sensors generally range in size from 20 micrometers (20 millionths of a meter) to a millimeter or more. The micro-sensor 64 can be fabricated using micromachining techniques and/or photolithography used in the fabrication of semiconductor devices. In one embodiment, the micro-sensor 64 is fabricated on a silicon substrate.

In one non-limiting embodiment, the micro-sensor 64 is configured to measure pH using a nanocrystalline diamond (NCD) doped with boron or nitrogen to form p-type (boron doping) or n-type (nitrogen doping) conduction. The nanocrystalline diamond, grown by hot filament chemical vapor deposition (CVD), is monolithically integrated on a Ga/AlN transistor. The surface of the NCD can be modified by ultraviolet light in air in order to improve the features of the NCD in terms of electrical conductivity and chemical reactivity. The sensor 64 as a diamond chemical micro-system provides pH sensitivity close to the Nernst's limit in the range between pH1 and pH13, and its corresponding detecting resolution is about 50 mV/pH.

The use of multiple sensors 64 measuring the same parameter at various locations at the BHA 26 can be useful in order to compare measurements and correct associated data, which can minimize system errors. Because the micro-sensors 64 require very little space, the micro-sensors 64 can be located at the various locations at the BHA 26 and at various positions along the drillstring 11. For example, the micro-sensor 64 can be located at the MWD 60, the drill bit assembly 22, and/or a fluid analyzer sampler (FAS), which may be disposed at the BHA 26. The FAS is configured to receive and chemically analyze a formation fluid. Because of the small size of the micro-sensor 64, one or more micro-sensors 64 can be integrated into an existing FAS. In this embodiment, there is an advantage that the data from the micro-sensor 64 configured for chemical analysis can be compared with the data from the FAS so as to enhance information accuracy and/or extract the contribution by the formation of certain species.

FIG. 2 illustrates an exemplary embodiment of the micro-sensor 64 disposed at the MWD tool 60. The micro-sensor 64 is mounted flush or recessed with respect to an outer surface of a collar 61.

In one embodiment, the micro-sensor 64 may be mounted in a plug or screw 67 as shown in FIG. 3. Referring to FIG. 3, the micro-sensor 64 is disposed in a recess 65 of the head of the screw 67. Leads 69 are disposed internal to the thread section of the screw 67. The screw 67 containing the micro-sensor 64 can be mounted at the collar 61 as shown in FIG. 2.

Figure 4A:
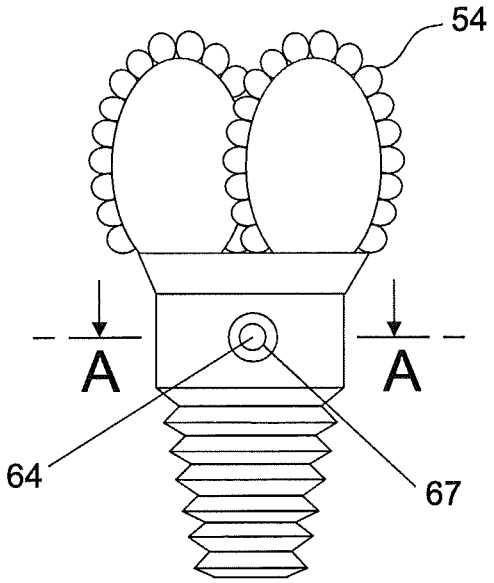
FIGS. 4A and 4B, collectively referred to as FIG. 4, illustrate an exemplary embodiment of the micro-sensor disposed in a drill bit.
Figure 4B:
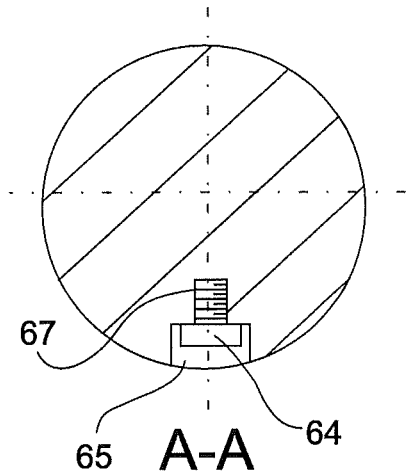

In one embodiment, the micro-sensor 64 for performing chemical analysis is placed close to the drill bit 54 as shown in FIG. 4. FIG. 4A illustrates a side view of the drill bit 54 containing the chemical micro-sensor 64. FIG. 4B illustrates a top cross-sectional view of the drill bit 54 with the micro-sensor 64 disposed in the recess 65 of the screw 67. When the chemical micro-sensor 64 is disposed at the drill bit 54, the chemical micro-sensor 64 can detect the influence of the formation on the drilling fluid 24 at an early stage.

The chemical micro-sensor 64 can also be placed in a formation pressure tester (FPT) 78 disposed at the BHA 26 as shown in FIG. 5. The FPT 78 is configured to estimate the pressure of the formation fluid. In general, the FPT 78 includes a formation coupling 79 configured to extend from the FPT 78 and engage the wall of the formation within borehole 12. The coupling 79 coupled to the wall forms an enclosed volume. The pressure within the volume is reduced until the formation fluid enters the volume. This final pressure is used to estimate the formation fluid pressure. By including the chemical micro-sensor 64 in the FPT 78, a chemical analysis of the formation fluid entering the coupler 79 can be performed.

Referring back to FIG. 1, in one embodiment, the tool 60 is equipped with transmission equipment 66 to communicate ultimately to a surface processing unit 68. In one embodiment, the surface processing unit 68 is configured as a surface drilling control unit which controls various drilling parameters such as rotary speed, weight-on-bit, drilling fluid flow parameters and others. Such transmission equipment 66 may take any desired form, and different transmission media and connections may be used. Examples of connections include wired, fiber optic, wireless connections or mud pulse telemetry. In one embodiment, the surface control unit 68 is coupled to a sensor 64 placed in the fluid line 50 and is used to control the drilling operation and to display desired drilling parameters and other information on a display/monitor 72.

In one embodiment, the system 10 includes a downhole telemetry system 74, which in turn transmits the received data uphole to the surface control unit 68. The downhole telemetry also receives signals and data from the surface control unit 68 and transmits such received signals and data to the downhole tool 60. In one embodiment, mud pulse telemetry is used to communicate data from downhole sensors 64 and other components during drilling operations. Other telemetry techniques, such electromagnetic and acoustic techniques or any other suitable technique may be utilized.

In one embodiment, the surface processing unit 68 and/or the tool 60 include components as necessary to provide for storing and/or processing data collected from the sensor(s) 64. Exemplary components include, without limitation, at least one processor, storage, memory, input devices, output devices and the like. The surface processing unit 68 optionally is configured to control the tool 60.

Figure 6:
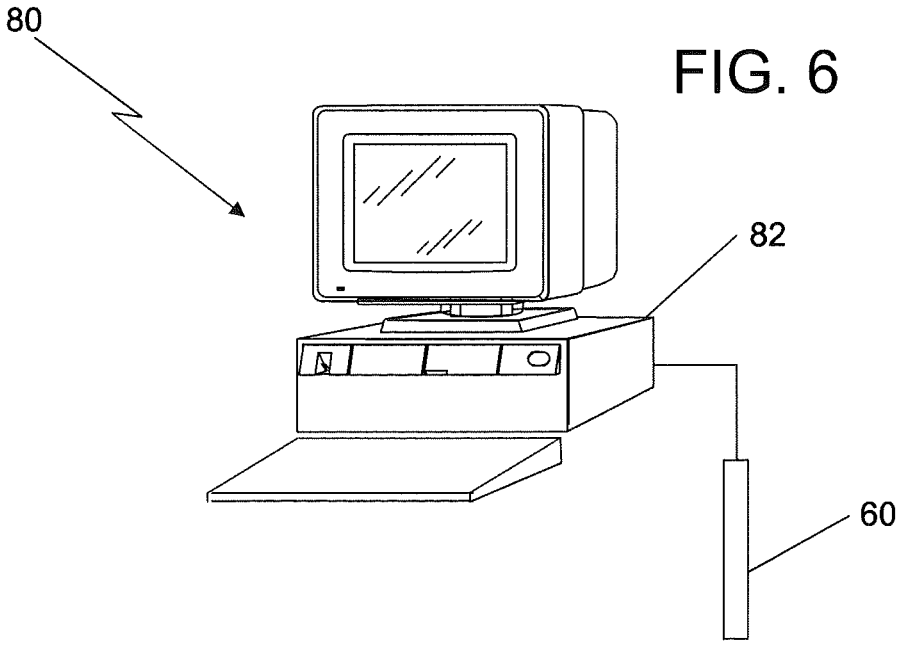
FIG. 6 is a block diagram of an embodiment of a system for monitoring and controlling a load on a downhole tool.

Referring to FIG. 6, there is provided a system 80 for monitoring and controlling a load on a downhole tool or other component used in conjunction with the BHA 26 and/or the drillstring 11. The system 80 may be incorporated in a computer or other processing unit capable of receiving data from the tool 60. The processing unit may be included with the tool 60 or included as part of the surface processing unit 68.

In one embodiment, the system 80 includes a computer 82 coupled to the tool 60. Exemplary components include, without limitation, at least one processor, storage, memory, input devices, output devices and the like. As these components are known to those skilled in the art, these are not depicted in any detail herein. The computer 82 may be disposed in at least one of the surface processing unit 68 and the tool 60.

Generally, some of the teachings herein are reduced to an algorithm that is stored on machine-readable media. The algorithm is implemented by the computer 82 and provides operators with desired output.

Figure 7:
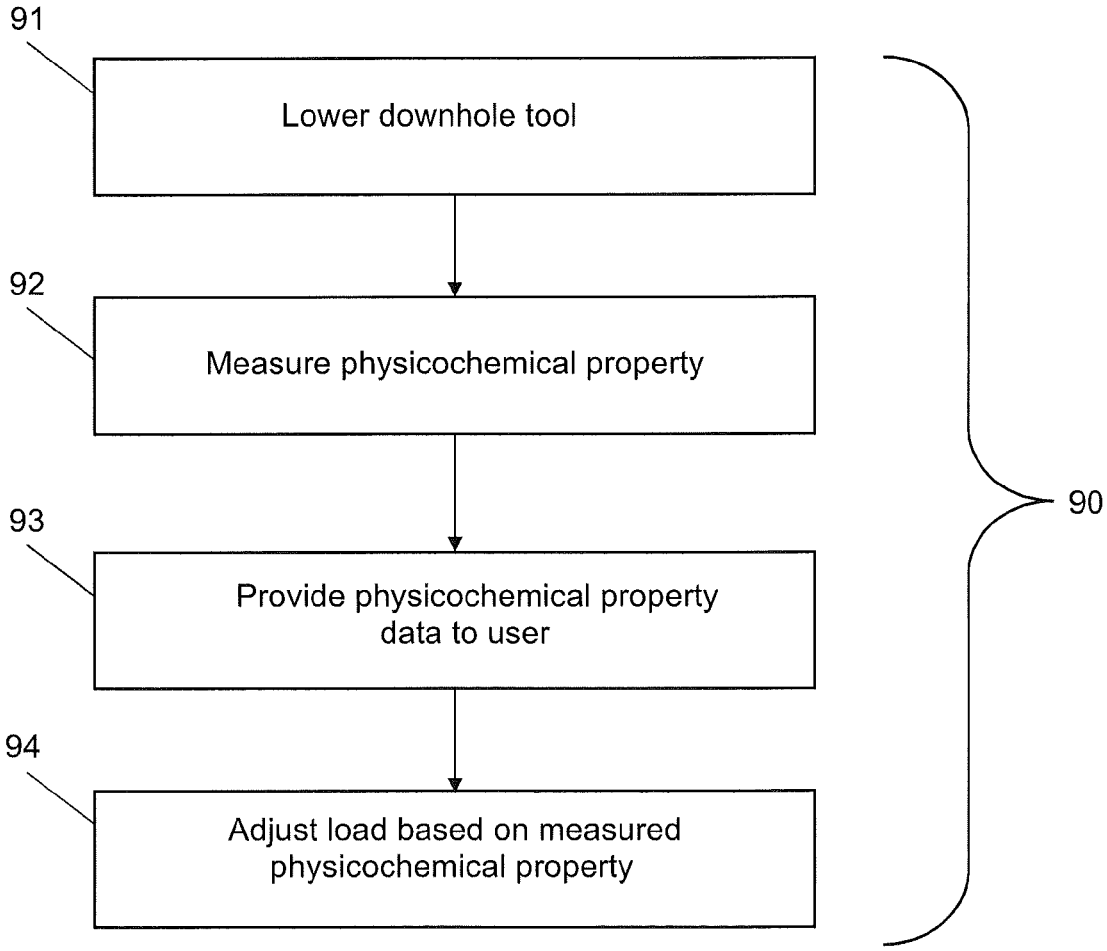
FIG. 7 is a flow chart providing an exemplary method of controlling a load on a downhole tool.

FIG. 7 illustrates a method 90 for controlling a load on a downhole tool. The method 90 includes one or more of stages 91-94 described herein. The method may be performed continuously or intermittently as desired. The method is described herein in conjunction with the tool 60 and the sensor(s) 64, although the method may be performed in conjunction with any number and configuration of processors, sensors and tools. The method may be performed by one or more processors or other devices capable of receiving and processing measurement data, such as the microprocessor and/or the computer 81. In one embodiment, the method includes the execution of all of stages 91-94 in the order described. However, certain stages 91-94 may be omitted, stages maybe added, or the order of the stages changed.

In the first stage 91, the downhole tool 60 and/or the BHA 26 is lowered into a borehole during a drilling and/or geosteering operation.

In the second stage 92, one or more physicochemical properties of the borehole environment are measured. Such measurements may be carried out during a drilling operation and/or during stand-by intervals.

In the third stage 93, physicochemical property data retrieved from the sensors 64 is provided to a user and may be used to record and/or monitor the measured values of physicochemical properties of the borehole environment, including for example environmental pH value and concentrations of $O_2$, $H_2$, $H_2S$ and/or $CO_2$. In one embodiment, the data is stored in the tool 60 and/or transmitted to a processor such as the surface processing unit 68, and can be retrieved therefrom and/or displayed for analysis. As used herein, a "user" may include a drillstring operator, a processing unit and/or any other entity selected to retrieve the data and/or control the drillstring 11.

In one embodiment, a threshold value and/or range of values for each physicochemical property is selected, and the measured physicochemical property values are compared to the selected threshold and/or range.

In the fourth stage 94, at least one load on the downhole tool 60, BHA 26 or other component of the drillstring 11 is adjusted in response to measurement of the physicochemical property or change in the physicochemical property beyond a selected threshold or range of values. In one embodiment, the at least one load is adjusted in response to measurement of a physicochemical property value that is outside of the selected threshold and/or range. In one embodiment, the load is adjusted immediately upon detection of a physicochemical property beyond or exceeding a selected threshold. In one embodiment, changes or adjustments to the loads are automatically performed, for example, by the tool 60 in a short bottom hole closed loop or by the surface processing unit 68 in a long bottom-to-surface closed loop. For the latter, in one embodiment, telemetry is bi-directional between the tool 60 and the surface processing unit 68.

Such loads include various mechanical loads such as a weight on the drill bit 54, flow of drilling fluid 24 through the drillstring 11, pressure and drill bit 54 rotational speed. Such loads also include environmental loads such as temperature, acidity, chemical composition, density and viscosity of the drilling fluid 24.

In one example, a mechanical load is adjusted by reducing one or more of the drilling fluid pressure, the weight on the drill bit 54 and the drill bit 54 rotational speed. The density and/or viscosity of the drilling fluid may also be reduced. In another example, the load is adjusted by steering the drillstring 11 toward a different selected location to reduce the corrosive effects of the physicochemical properties.

In another example, if a low pH level is detected, i.e., the pH value is below the selected threshold or range, the load is adjusted by treating the surrounding drilling fluid 24 to reduce acidity. An exemplary treatment is a lime treatment. Additional treatments include the addition of lye or other suitable bases to raise the pH level.

In another example, in response to oxygen levels above a selected threshold, various chemicals such as nitrogen are introduced into the drilling fluid 24 to remove dissolved oxygen. In another example, $H_2S$ concentration is reduced by introducing a sulphide scavenging chemical such as zinc into the drilling fluid 24.

In another example, upon detection of chloride concentrations above a selected threshold or range, the drilling fluid 24 is treated to decrease the chloride concentration. One exemplary treatment includes reducing the chloride concentration by one or more desalination processes.

Figure 8:
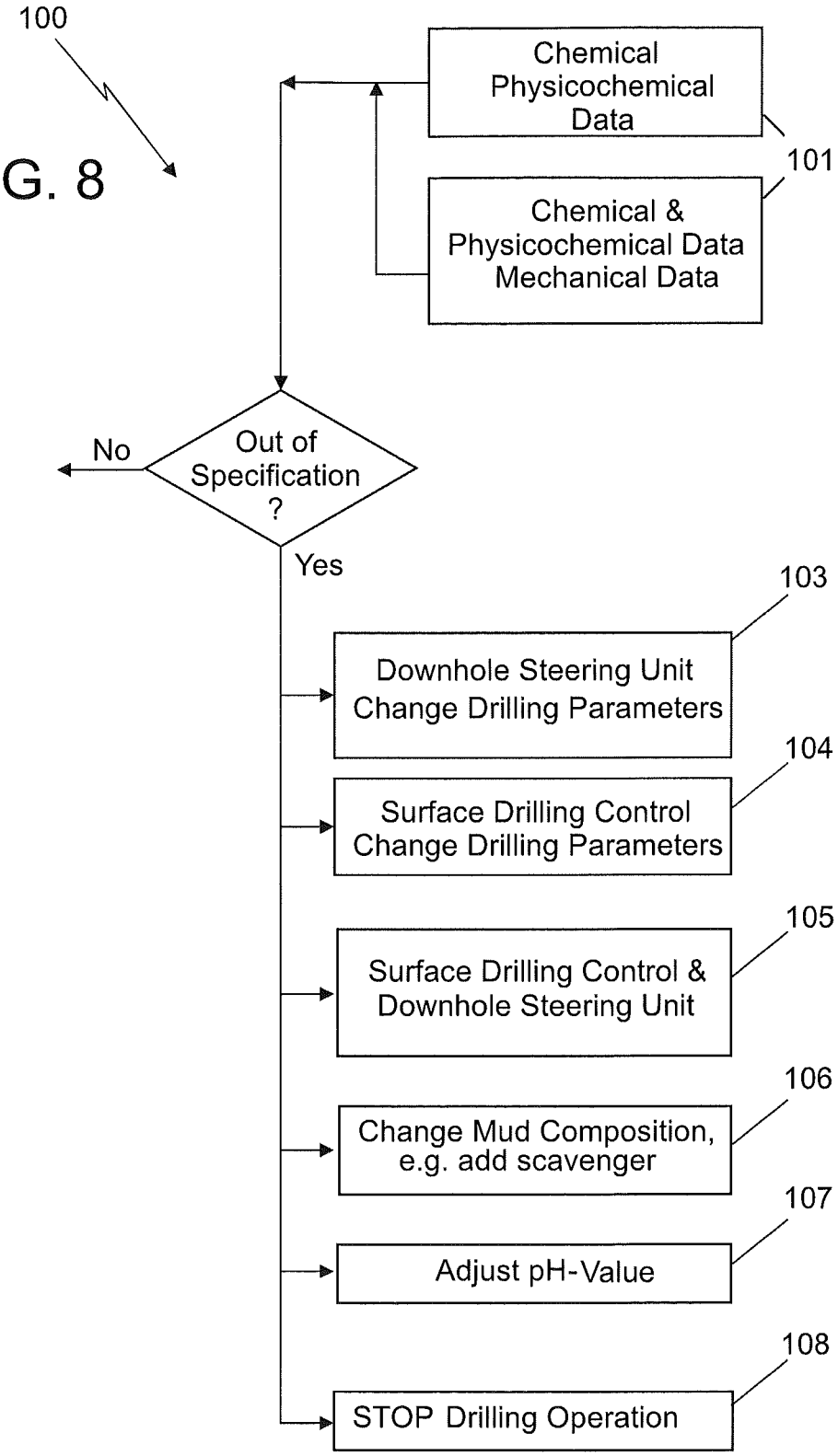
FIG. 8 is a flow chart providing another exemplary method of controlling a load on a downhole tool.

FIG. 8 illustrates a method 100 for controlling a load on a downhole tool. The method 100 includes one or more of stages 101-108 described herein. The method may be performed continuously or intermittently as desired. The method is described herein in conjunction with the surface processing unit 68 configured as a surface drilling control unit and/or the downhole steering unit, although the method may be performed in conjunction with any number and configuration of processors, sensors and tools. The method may be performed by one or more processors or other devices capable of receiving and processing measurement data, such as the microprocessor and/or the computer 81. In one embodiment, the method includes the execution of all of stages 101-108 in the order described. However, certain stages 101-108 may be omitted, stages may be added, or the order of the stages changed.

In the first stage 101, the sensors 64 measure various physicochemical, chemical and/or mechanical properties during a drilling operation and/or during stand-by intervals. As discussed above, examples of chemical or physicochemical properties include environmental pH value and concentrations of $O_2$, $H_2$, $H_2S$ and/or $CO_2$, and examples of mechanical properties include weight on the drill bit 54, drilling fluid 24 flow through the drillstring 11, pressure and drill bit 54 rotational speed. Data related to these properties is collected and/or calculated in a processor in the downhole tool 60 and/or the surface processing unit 68.

In the second stage 102, the data is compared to a selected threshold. If the data represents a property that is outside a selected range, or is above or below a selected threshold as required, various loads are adjusted to reduce the damaging or corrosive effect of the property. As shown in FIG. 4, this condition is referred to as "out of specification". If the data is out of specification, one or more of various loads as desired are adjusted as shown in stages 103-108.

In the third stage 103, selected drilling parameters are adjusted. Such parameters include, for example, rotary speed, weight-on-bit and drilling direction. In one embodiment, these adjustments are performed by the downhole steering unit. In the fourth stage 104, selected drilling parameters are adjusted by the surface processing unit 68. In the fifth stage 105, both the surface processing unit 68 and the downhole steering unit are utilized to adjust drilling parameters.

In the sixth stage 106, a composition of the drilling fluid 24 is adjusted as desired. Such adjustments include changing viscosity and/or changing various chemical concentrations using for example a suitable scavenger. In the seventh stage 107, the pH value of the drilling fluid is adjusted.

In the eight stage 108, the drilling and/or geosteering system 10 is shut down in response to the detection of a measured physicochemical property beyond the selected threshold.

Figure 9:
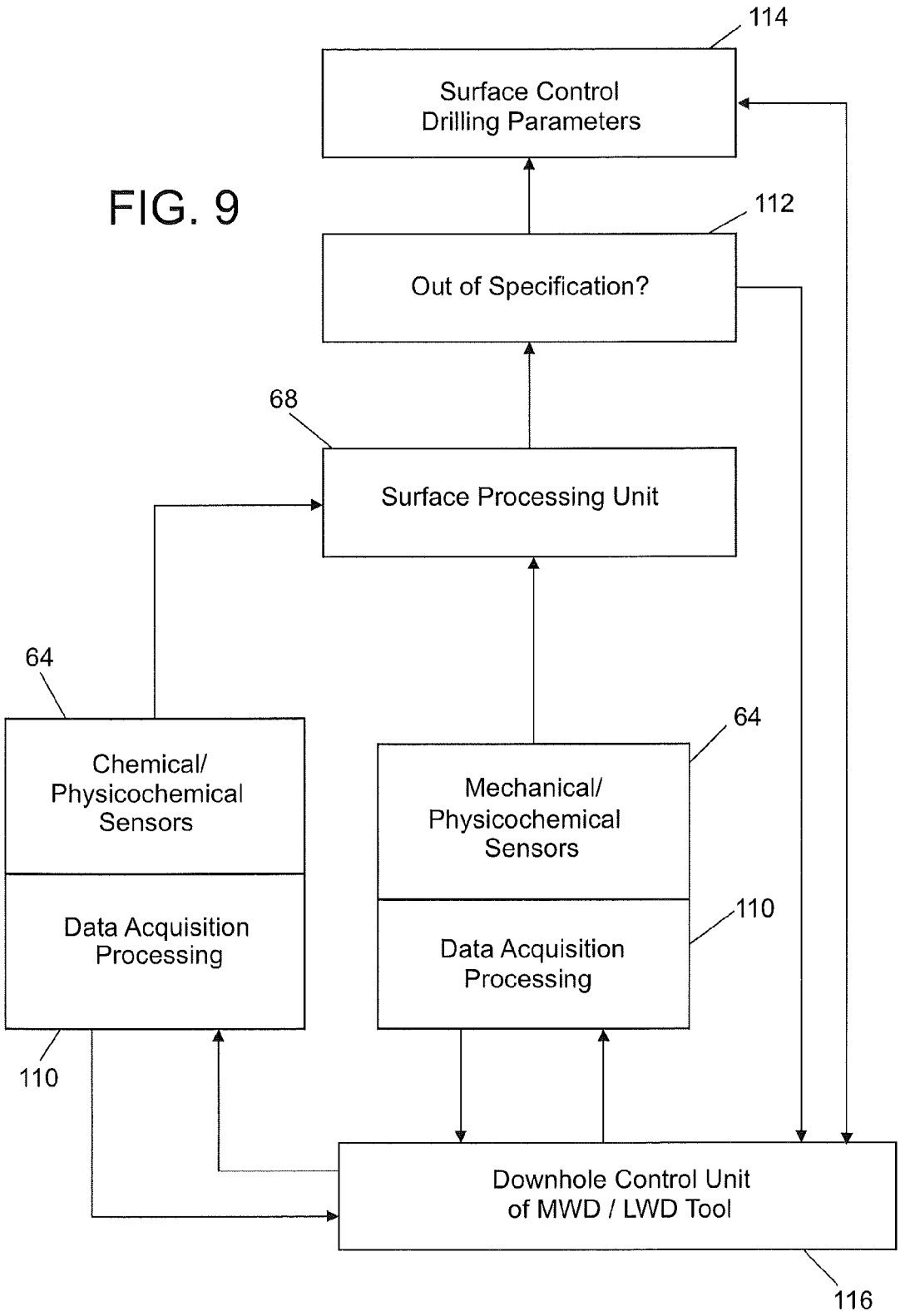
FIG. 9 is a block diagram illustrating the operation of an exemplary embodiment of a system for monitoring and controlling a load on a downhole tool.

Referring to FIG. 9, a block diagram is shown illustrating an example of the utilization of the surface processing unit 68 and a downhole control unit 116 of the tool 60 to control loads on downhole components.

In this example, chemical/physicochemical sensors 64 and/or mechanical/physicochemical sensors 64 measure selected properties of the downhole components and/or the downhole environment. In one embodiment, the sensors 64 include or are otherwise operably connected to suitable data acquisition processing units 110 for receiving and processing measurement data.

The sensors 64 are in operable communication with the surface processing unit 68 and provide property data thereto. The sensors 64 are also in operable communication with the downhole control unit 116 and may exchange data therebetween.

In one embodiment, the surface processing unit receives property data from the sensors 64 and/or the downhole control unit 116 and performs a comparison 112 to selected thresholds to determine whether the measured data is out of specification. In the data is out of specification, various surface control drilling parameters 114 are adjusted to compensate and reduce the load(s) on the downhole components.

The systems and methods described herein provide various advantages over prior art techniques. The systems and methods herein allow for control of mechanical and/or environmental loads in response to varying environmental impacts on the downhole tools and drillstring components in order to improve tool reliability and increase tool life. In addition, the inclusion of chemical and/or physicochemical sensors allows for the generation a more complete set of stress factors to the downhole tool than is available from prior art techniques.

Prior art techniques have generally focused on sensitizing hydrocarbon detection and oil/water ratio analysis to improve drilling efficiency, intelligence, and accuracy. Such techniques generally do not include analysis of the interaction between drilling/geosteering tools and the service environment during drilling operation, such as tool corrosion and reaction with a service medium. However, tool degradation and failures due to environmental factors, as well as the corresponding production down-time, pose a significant disadvantage. The system and methods described herein are advantageous in that they provide the ability to control an integrity of a drilling system, for example, by detecting the existence of key service medium species, in-situ measuring changes in environmental characteristics, processing the tested signal, and changing the drilling operational parameters in response to the tested signal to prevent tool failure and extend the service life cycles. Early detection of chemically induced wear may also support the logistics of replacing worn components at the rig site or in the repair facility In support of the teachings herein, various analyses and/or analytical components may be used, including a digital and/or an analog system. For example, the sensor(s) 64, the surface control unit 68, the downhole telemetry system 74, the logging tool 60, or the transmission equipment 66 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for monitoring and controlling a load on a downhole component of a well drilling system, the system comprising:

a downhole drilling tool disposed in operable communication with a drillstring and configured to be movable within a borehole, the drillstring configured to allow a drilling fluid to be advanced through the borehole;

at least one sensor disposed in operable communication with the downhole drilling tool for in-situ measurement of at least one chemical property of an environment surrounding the downhole drilling tool; and a processor configured to monitor the at least one chemical property during a drilling operation, to associate the at least one chemical property with a corrosion rate and at least one of i) adjust a mechanical load on the downhole drilling tool based on the corrosion rate, ii) steer the drillstring to a different location based on the corrosion rate and iii) shut down the drilling operation in response to detection of a corrosion rate beyond a selected threshold.

2. The system of claim 1, wherein the at least one chemical property is selected from at least one of acidity, electrical conductivity, chloride concentration, oxygen concentration, hydrogen concentration, carbon dioxide concentration and hydrogen sulphide concentration of the drilling fluid.

3. The system of claim 1, wherein the processor is configured to adjust the load in response to a change in the at least one chemical property that is at least one of an increase and a decrease beyond a selected threshold.

4. The system of claim 1, wherein the mechanical load is selected from at least one of a weight on a drill bit connected to the drillstring, a flow of the drilling fluid through the drillstring, a pressure and a rotational speed of the drill bit.

5. The system of claim 1, wherein the downhole drilling tool is a logging-while-drilling tool.

6. The system of claim 1, wherein the processor is configured to adjust a drilling direction based on the at least one chemical property.

7. The system of claim 1, wherein the sensor is disposed at a drill bit disposed at the drillstring, and the chemical property is a chemical property of a drilling fluid.

8. The system of claim 1, wherein the sensor is at least one of disposed in a formation pressure tester disposed at the drillstring and disposed at a drill bit disposed at the drillstring.

9. The system of claim 1, wherein the at least one chemical property includes at least one of an acidity level and a chemical concentration of the downhole fluid.

10. The system of claim 1, wherein the processor is configured to alert a user to the detection of a measured chemical property beyond a selected threshold.

11. The system of claim 1, wherein the drilling operation includes a geosteering operation.

12. A method of monitoring and controlling a load on a downhole component of a well drilling system, the method comprising:

disposing a downhole drilling tool in operable communication with a drillstring within a borehole, the downhole drilling tool including at least one sensor disposed in operable communication with the downhole drilling tool for measuring at least one chemical property of an environment surrounding the downhole drilling tool;

monitoring the at least one chemical property during a drilling operation;

associating the at least one chemical property with a corrosion rate; and at least one of i) adjusting a mechanical load on the downhole drilling tool based on the corrosion rate, ii) steering the drillstring to a different location based on the corrosion rate and iii) shutting down the drilling operation in response to detection of a measured corrosion rate beyond a selected threshold.

13. The method of claim 12, further comprising advancing a drilling fluid through the drillstring and into the borehole, wherein the chemical property is a chemical property of the drilling fluid.

14. The method of claim 12, wherein the chemical property is selected from at least one of acidity, electrical conductivity, chloride concentration, oxygen concentration, hydrogen concentration, carbon dioxide concentration and hydrogen sulphide concentration of the drilling fluid.

15. The method of claim 12, wherein the mechanical load is selected from at least one of a weight on a drill bit connected to the drillstring, a flow of the drilling fluid through the drillstring, a pressure and a rotational speed of the drill bit.

16. The method of claim 12, further comprising adjusting a drilling direction based on the at least one chemical property.

17. A computer program product stored on machine readable media for monitoring and controlling a load on a downhole component of a well drilling system by executing machine implemented instructions, the instructions for performing a method comprising:

disposing a downhole drilling tool in operable communication with a drillstring within a borehole, the downhole drilling tool including at least one sensor disposed in operable communication with the downhole drilling tool for measuring at least one chemical property of an environment surrounding the downhole tool;

monitoring the at least one chemical property during a drilling operation;

associating the at least one chemical property with a corrosion rate; and at least one of i) adjusting a mechanical load on the downhole drilling tool based on the corrosion rate, ii) steering the drillstring to a different location based on the corrosion rate, and iii) shutting down the drilling operation in response to detection of a measured corrosion rate beyond a selected threshold.

18. The computer program product of claim 17, wherein the chemical property is selected from at least one of acidity, electrical conductivity, chloride concentration, oxygen concentration, hydrogen concentration, carbon dioxide concentration and hydrogen sulphide concentration of the drilling fluid.

19. The computer program product of claim 17, wherein the mechanical load is selected from at least one of a weight on a drill bit connected to the drillstring, a flow of the drilling fluid through the drillstring, a pressure and a rotational speed of the drill bit.

20. The computer program product of claim 17, further comprising adjusting a drilling direction based on the at least one chemical property.

* * * * *